US011330959B2

(12) United States Patent
Alhaffar et al.

(10) Patent No.: US 11,330,959 B2
(45) Date of Patent: May 17, 2022

(54) SYSTEM AND METHOD FOR PERFORMING A FILL CYCLE IN A DISHWASHER APPLIANCE

(71) Applicant: Haier US Appliance Solutions, Inc., Wilmington, DE (US)

(72) Inventors: Nasib Alhaffar, Louisville, KY (US); Adam Christopher Hofmann, Louisville, KY (US); Kyle Edward Durham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/783,280

(22) Filed: Feb. 6, 2020

(65) Prior Publication Data

US 2021/0244257 A1 Aug. 12, 2021

(51) Int. Cl.
*A47L 15/42* (2006.01)
*A47L 15/23* (2006.01)

(52) U.S. Cl.
CPC ..... *A47L 15/4244* (2013.01); *A47L 15/23* (2013.01); *A47L 15/4221* (2013.01); *A47L 15/4223* (2013.01); *A47L 2401/09* (2013.01); *A47L 2401/14* (2013.01); *A47L 2401/20* (2013.01); *A47L 2501/01* (2013.01); *A47L 2501/03* (2013.01)

(58) Field of Classification Search
CPC ..... A47L 15/4244; A47L 15/4223; A47L 15/4221; A47L 15/23; A47L 2401/14; A47L 2401/20; A47L 2501/01; A47L 2501/03; A47L 2401/09
See application file for complete search history.

(56) References Cited

U.S. PATENT DOCUMENTS

| | | | | |
|---|---|---|---|---|
| 3,835,880 | A | 9/1974 | Hoffman et al. | |
| 8,845,813 | B2 | 9/2014 | Pers et al. | |
| 9,936,852 | B2 | 4/2018 | Forst et al. | |
| 2012/0125369 | A1* | 5/2012 | Pers | A47L 15/4217 134/18 |
| 2013/0008477 | A1* | 1/2013 | Forst | A47L 15/0023 134/57 D |
| 2014/0158163 | A1 | 6/2014 | Montgomery et al. | |
| 2019/0167066 | A1 | 6/2019 | Durham | |
| 2019/0179350 | A1 | 6/2019 | Durham | |

* cited by examiner

*Primary Examiner* — Michael E Barr
*Assistant Examiner* — Pallavi Chitta
(74) *Attorney, Agent, or Firm* — Dority & Manning, P.A.

(57) ABSTRACT

A dishwasher appliance includes a sump that defines a transition fill level where the cross sectional area of the sump increases. A pressure sensor is operably coupled to the sump for monitoring sump pressure and wash fluid level. A controller opens a water supply valve to provide a flow of water into the sump and monitors the sump pressure using the pressure sensor. The controller determines when the water has reached the transition fill level corresponding to a known transition fill volume. The controller determines a fill flow rate based on the amount of time needed to reach the transition fill volume and uses the fill flow rate to determine a remaining fill time needed to reach a target volume.

11 Claims, 6 Drawing Sheets

SYSTEM AND METHOD FOR PERFORMING A FILL CYCLE IN A DISHWASHER APPLIANCE

FIELD OF THE INVENTION

The present disclosure relates generally to dishwasher appliances, and more particularly to water level detection systems and methods for accurate fill cycles within dishwasher appliances.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a drain pump may periodically discharge soiled wash fluid that collects in the sump space and the process may be repeated.

Conventional dishwasher appliances may implement time-based fill cycles. In this regard, fill cycle algorithms may simply divide the desired volume by an estimated valve flow rate to obtain a fill time. A water supply valve is then opened for the calculated fill time. However, water supply valves commonly exhibit variability or inconsistency in flow rates. In addition, these flow rates may vary over the lifetime of a given valve, e.g., due to valve wear or degradation. Furthermore, water supply pressures may vary and affect the flow rate through the water supply valve. Failure to compensate for such variations in fill rates can result in overfilling or underfilling the sump and decreased wash performance.

Accordingly, a dishwasher appliance having improved features for determining the water level in the sump would be desirable. More specifically, a dishwasher appliance with an improved water level detection system and methods of performing a fill cycle would be particularly beneficial.

BRIEF DESCRIPTION OF THE INVENTION

Aspects and advantages of the invention will be set forth in part in the following description, or may be apparent from the description, or may be learned through practice of the invention.

In a first example embodiment, a dishwasher appliance is provided including a wash tub that defines a wash chamber, a sump for collecting water, the sump defining a transition fill level, and a water supply valve for selectively providing a flow of water into the sump. A pressure sensor is operably coupled to the sump and a controller is communicatively coupled with the pressure sensor and the water supply valve. The controller is configured for obtaining a start volume, opening the water supply valve to provide the flow of water into the sump, monitoring a sump pressure using the pressure sensor, determining, based on the sump pressure, that the water has reached the transition fill level, obtaining a transition fill volume of the water in the sump at the transition fill level and a transition fill time for the water to reach the transition fill level, determining a fill flow rate based on the transition fill volume, the start volume, and the transition fill time, and determining a remaining fill time based on a target volume and the fill flow rate.

In a second example embodiment, a method for performing a fill cycle of a dishwasher appliance is provided. The dishwasher appliance includes a sump for collecting water, the sump defining a transition fill level, a water supply valve for providing a flow of water into the sump, and a pressure sensor operably coupled to the sump. The method includes obtaining a start volume, opening the water supply valve to provide the flow of water into the sump, monitoring a sump pressure using the pressure sensor, determining, based on the sump pressure, that the water has reached the transition fill level, obtaining a transition fill volume of the water in the sump at the transition fill level and a transition fill time for the water to reach the transition fill level, determining a fill flow rate based on the transition fill volume, the start volume, and the transition fill time, and determining a remaining fill time based on a target volume and the fill flow rate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
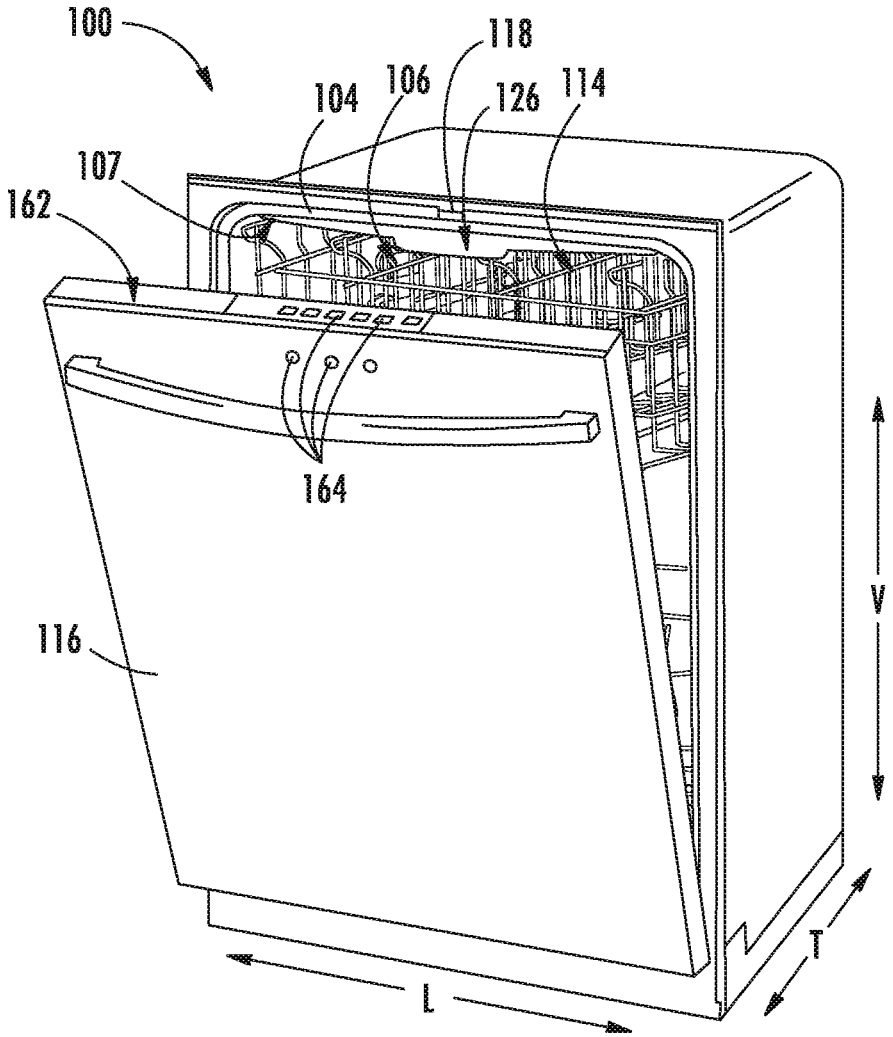
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment.

Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
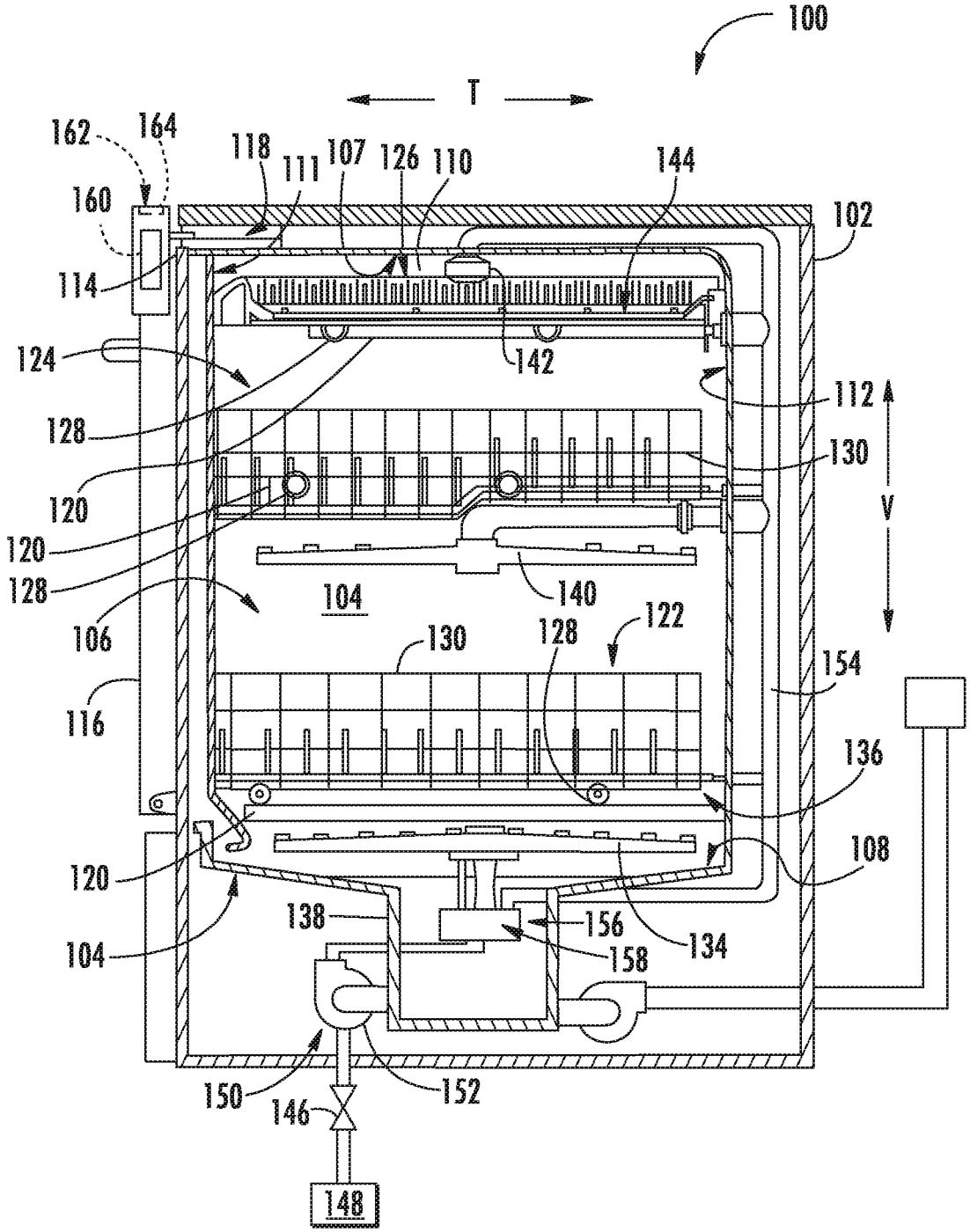
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

Dishwasher 100 may further include a water supply valve 146 positioned between an external water supply 148 and a circulation pump (such as pump 152 described below) to selectively allow water to flow from the external water supply 148 into circulation pump 152. Additionally or alternatively, water supply valve 146 can be positioned between the external water supply 148 and sump 138 to selectively allow water to flow from the external water supply 148 into sump 138. Water supply valve 146 can be selectively controlled to open and allow the flow of water into dishwasher 100 and can be selectively controlled to cease the flow of water into dishwasher 100.

The various spray assemblies, manifolds, and water supplies described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds, e.g., during wash and/or rinse cycles. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for spraying an auxiliary rack such as the silverware rack.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Figure 3:
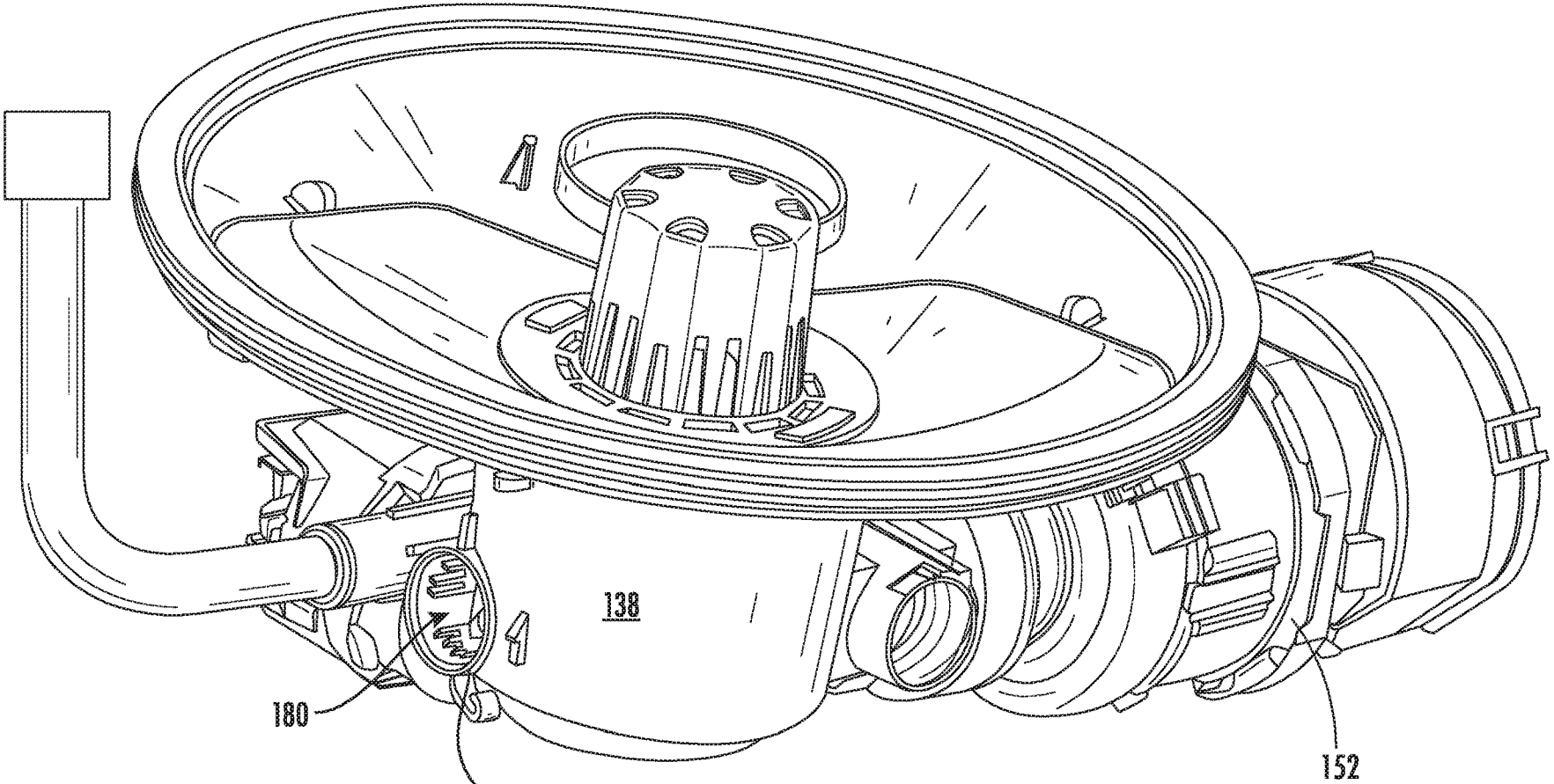
FIG. 3 provides a perspective view of a sump assembly of the exemplary dishwashing appliance of FIG. 1 according to an example embodiment of the present subject matter.
Figure 4:
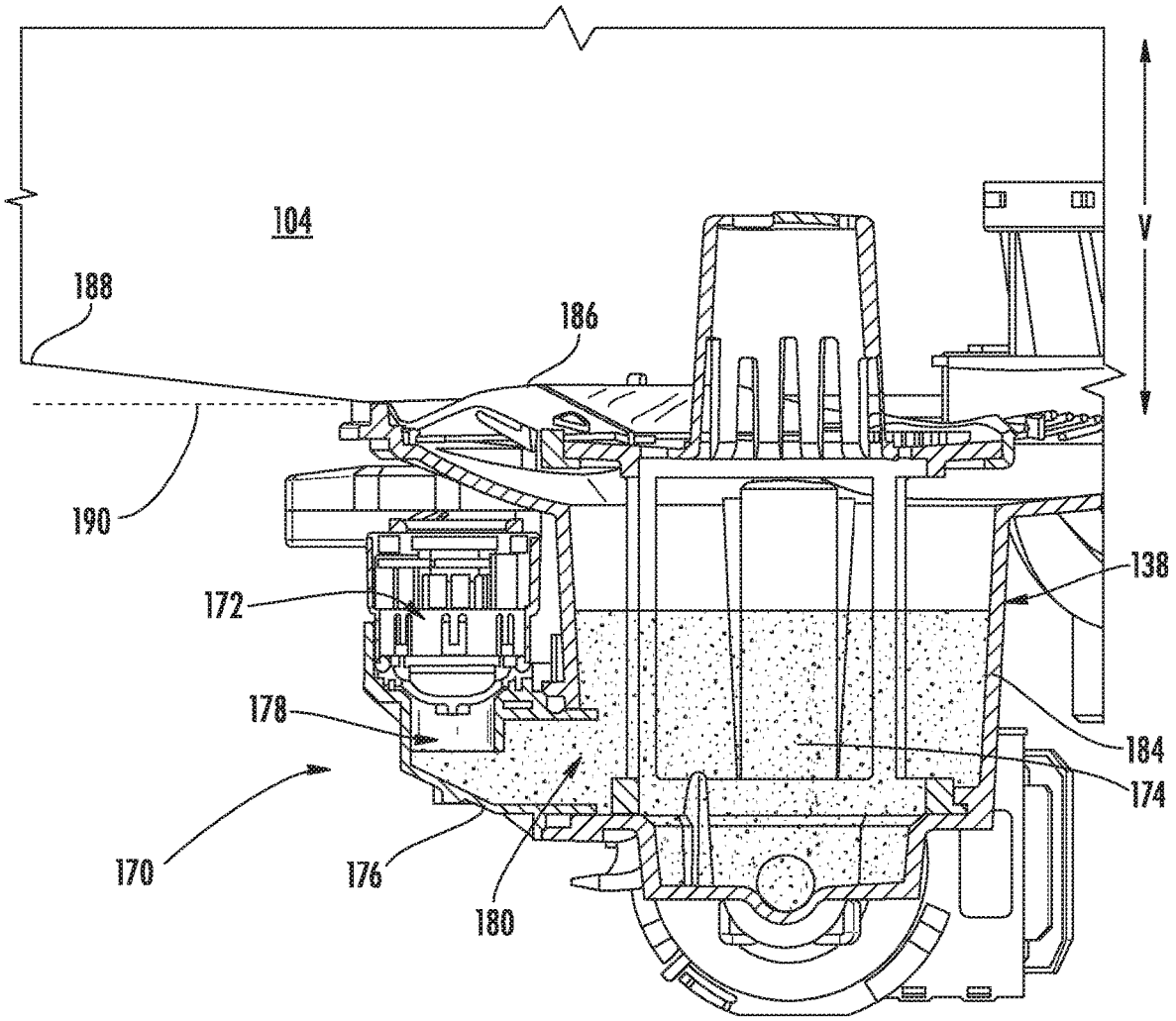
FIG. 4 provides a cross sectional view of the exemplary sump assembly of FIG. 3.

Referring now generally to FIGS. 3 and 4, a water level detection system 170 according to an exemplary embodiment of the present subject matter will be described. Water level detection system 170 may generally be configured for continuously or periodically measuring a level of water or wash fluid within dishwasher 100. Water level detection system 170 described herein is only one exemplary configuration used for the purpose of explaining aspects of the present subject matter and is not intended to limit the scope of the invention in any manner.

As illustrated, a water level detection system 170 includes a pressure sensor 172 operably coupled to sump 138 for measuring a pressure of wash fluid 174 (see FIG. 4) within sump 138 to facilitate wash fluid level detection. According to the illustrated embodiment, pressure sensor 172 is mounted to a receiving boss 176 defined by sump 138. More specifically, receiving boss 176 may further define an air chamber 178 that provides a vertical gap between pressure sensor 172 and the level of wash fluid 174 within receiving boss 176, e.g., to prevent contamination or fouling of pressure sensor 172.

In general, pressure sensor 172 may be any sensor suitable for determining a water level within sump 138 based on pressure readings. For example, pressure sensor 172 may be a piezoelectric pressure sensor and thus may include an elastically deformable plate and a piezoresistor mounted on the elastically deformable plate. However, it should be appreciated that according to alternative embodiments, pressure sensor 172 may be any type of pressure sensor that is fluidly coupled to sump 138 in any other suitable manner for obtaining sump pressures to facilitate water level detection.

Water level detection system 170 and pressure sensor 172 generally operate by measuring a pressure of air within air chamber 178 and using the measured chamber pressure to estimate the water level in sump 138. For example, when the water level within sump 138 falls below a chamber inlet 180, the pressure within air chamber 180 normalizes to ambient or atmospheric pressure, and thus reads a zero pressure. However, when water is present in sump 138 and rises above chamber inlet 180, the measured air pressure becomes positive and may increase proportionally with the water level. Although sump 138 is described herein as containing water, it should be appreciated that aspects of the present subject matter may be used for detecting the level of any other suitable wash fluid or liquid in any other appliance.

Notably, aspects of the present subject matter are directed to improving the accuracy of fill cycles using water level detection system 170 and based at least in part on the geometry of sump 138 and/or tub 104. For example, according to the illustrated embodiment, sump 138 is generally in the shape of an upright cylinder is mounted at a bottom of the tub 104. Thus, as best illustrated in FIG. 4, sump 138 includes a cylindrical sidewall 184 that extends substantially along the vertical direction V. In addition, sump 138 may define a transition shoulder 186 where cylindrical sidewalls 184 taper outward and merge into relatively flat bottom walls 188 of tub 104. Notably, the cross-sectional area of sump 138 (e.g., taken within a horizontal plane) may increase at or above transition shoulder 186, which may be referred to herein as the transition fill level 190 (see dotted line in FIG. 4). As used herein, the term "transition fill level" is generally intended to refer to a vertical location within sump 138 or tub 104 where the fill geometry changes, e.g., in a manner that may be identified on a sump pressure curve or by otherwise monitoring sump pressure during a filling process.

As explained in further detail below, pressure sensor 172 may be used to detect the change in fill rate or sump pressure associated with the water level reaching transition shoulder 186 or the transition fill level 190 and this data can be used to approximate a fill flow rate and accurately determine the remaining fill time. Specifically, due to this geometry, when a water valve is opened such that water or wash fluid 174 is provided into sump 138, the pressure measured by pressure sensor 172 increases in a manner that corresponds in part with the geometry of the sump 138 and tub 104. Thus, for example, if the flow of water is substantially constant, the measured pressure will increase in a substantially linear or proportional manner when the water level remains within the cylindrical sidewalls 184 of sump 138.

Figure 6:
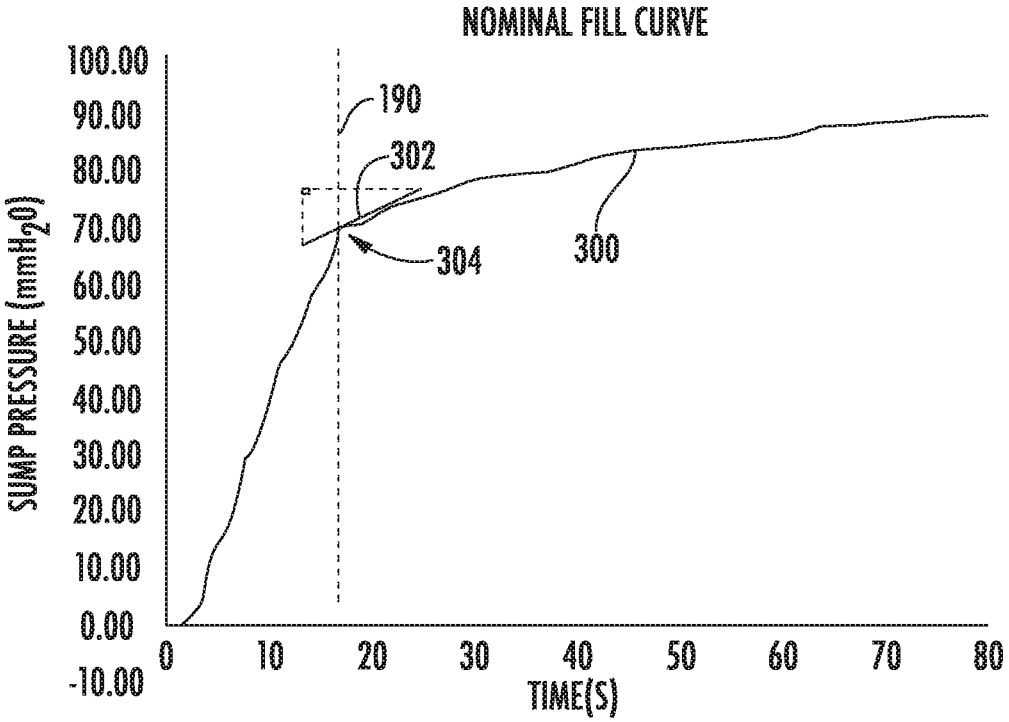
FIG. 6 is a plot of a sump pressure curve of the measured sump pressure over time during a fill cycle according to an exemplary embodiment of the present subject matter.

After the wash fluid 174 breaches the top of the cylindrical sidewalls 184, i.e., at transition shoulder 186, the measured pressure will still increase, but at a slower rate (see, e.g., FIG. 6 for an exemplary sump pressure curve 300). Aspects of the present subject matter are directed toward detecting that decrease in the water level fill rate. Then, because the geometry and fill volume required to reach transition shoulder 186 may be known or accurately determined, this fill volume (referred to herein as the "transition fill volume") may be used to help calculate the fill flow rate, as will be described in more detail below.

Although a specific geometry of sump 138 and a corresponding sump pressure curve are illustrated herein for explaining aspects of the present subject matter, it should be appreciated that according to alternative embodiments other suitable sump geometries and pressure curves may be used while remaining within the scope of the present subject matter. In this regard, for example, any change in sump geometry that generates a detectable pressure difference during a fill cycle may be used to help calculate a fill flow rate. For example, according to alternative embodiments, sump 138 may define a necked or narrowed region within sump 138 where there is an identifiable increase in the fill rate. The fill volume and corresponding fill time that is required to reach the narrowed region may be used to approximate the fill flow rate. This fill flow rate may be used to accurately predict the additional volume of water added to tub 104 based on the additional time that water supply valve 146 is open.

Now that the construction of dishwasher appliance 100 and the configuration of controller 160 according to exemplary embodiments have been presented, an exemplary method 200 of operating a dishwasher appliance will be described. Although the discussion below refers to the exemplary method 200 of operating dishwasher appliance 100, one skilled in the art will appreciate that the exemplary method 200 is applicable to the operation of a variety of other dishwasher appliances or other suitable appliances. In exemplary embodiments, the various method steps as disclosed herein may be performed by controller 160 or a separate, dedicated controller.

Figure 5:
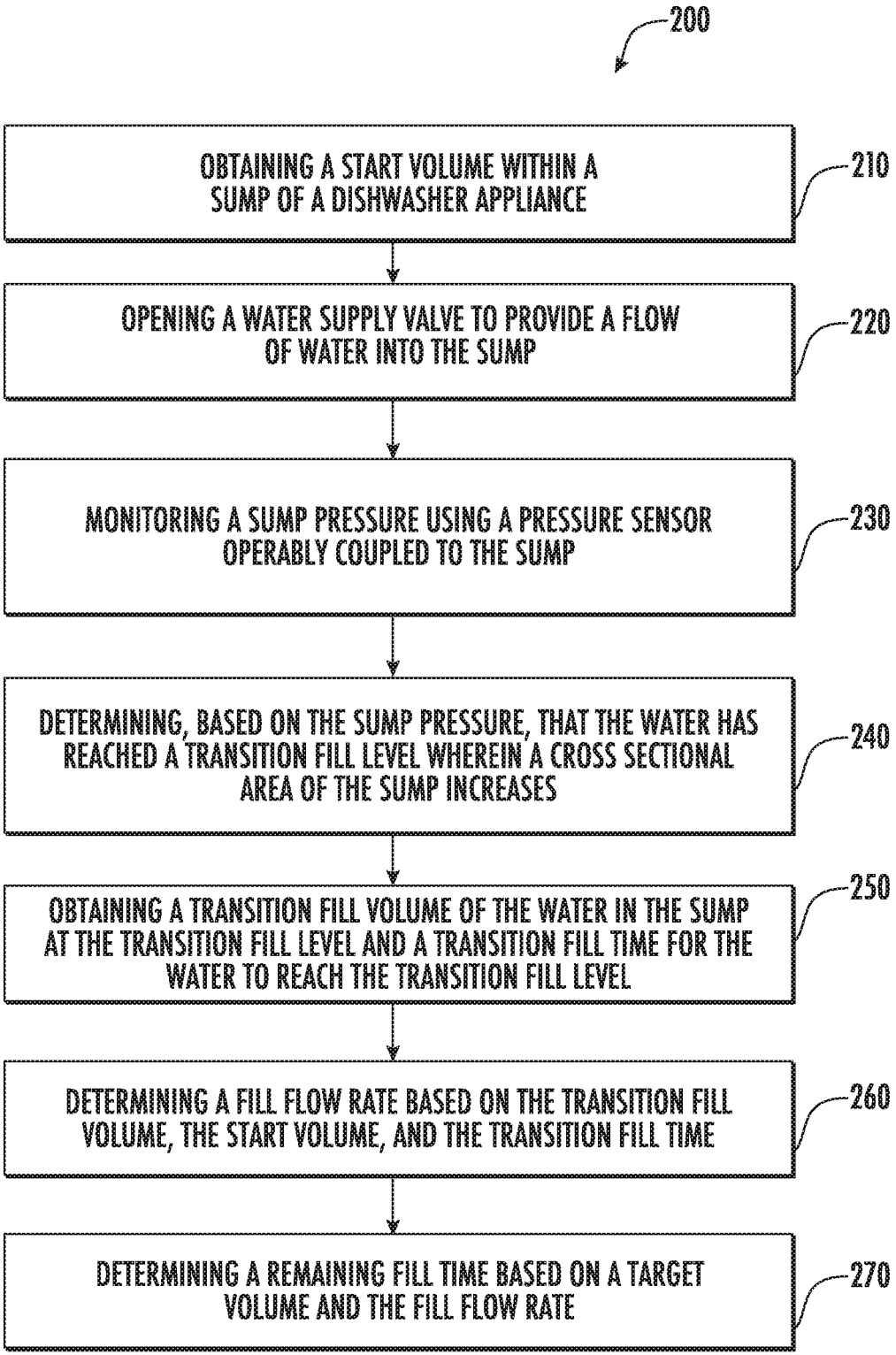
FIG. 5 provides a method of performing a fill cycle of the exemplary dishwasher appliance of FIG. 1 according to an exemplary embodiment.

Referring now to FIG. 5, method 200 includes, at step 210, obtaining a start volume within a sump of a dishwasher appliance. In this regard, as explained in more detail below, a difference between the start volume and the transition fill volume is used in determining precisely how much water has been added to sump 138 to reach the transition fill level, thereby facilitating the calculation of the fill flow rate. It should be appreciated that according to exemplary embodiments the start volume is substantially equivalent to zero, i.e., if the sump is empty at the beginning of the fill cycle. Alternatively, the start volume may be a positive value if water or wash fluid remains within sump 138 prior to initiation of method 200. Moreover, according to exemplary embodiments, method 200 may be implemented and the fill flow rate may be calculated during any fill cycle that starts when the fluid within sump 138 is at any volume below the transition fill volume. Thus, although in practice the sump 138 will often be empty at the start of a fill cycle, such a condition is not required for performance of method 200.

Step 220 includes opening a water supply valve to provide a flow of water into the sump. In this regard, the fill cycle may be initiated by opening a water supply valve 146 to provide the flow of water into sump 138. According to exemplary embodiments, water supply valve 146 is open to a specific position such that a substantially constant flow rate of water is provided. Step 230 includes monitoring a sump pressure using a pressure sensor operably coupled to the sump. In this regard, as explained above, pressure sensor 172 may be used to monitor a sump pressure, and controller 160 may be used to approximate the water level within sump 138 based on the measured sump pressure. Referring briefly to FIG. 6, an exemplary sump pressure curve 300 is illustrated which may correspond to the sump pressure within sump 138 during a fill process at a constant flow rate.

Step 240 includes determining, based on the sump pressure, that the water has reached the transition fill level where a cross sectional area of the sump increases or otherwise changes in a detectable manner. In this regard, continuing example from above, the transition fill level 190 may refer to the vertical height where cylindrical sidewalls 184 taper into bottom walls 188 of tub 104, e.g., at the transition shoulder 186. Acording to exemplary embodiments, determining that the wash fluid has reached the transition fill level 190 may be determined using controller 160 based on measured sump pressures.

In this regard, for example, controller 160 may obtain a first pressure reading and a second pressure reading a predetermined amount of time after the first pressure reading. Controller 160 may then determine that the transition fill level has been reached if a difference between the first pressure reading and the second pressure reading falls below a predetermined pressure difference. In this regard, based on the sump geometry and a known measurement frequency, controller 160 may know the wash fluid level based on the pressure difference of sequential pressure readings.

According to alternative embodiments, determining that the wash fluid has reached the transition fill level may be based on a sump pressure curve 300, e.g., a plot of sump pressure over time during a fill cycle. In this regard, controller 160 may simply monitor the rate of increase of the sump pressure and determine that the transition fill level has been reached if the rate of increase falls below a predetermined threshold rate. For example, the transition fill level may be identified by taking a first derivative (i.e., a slope) of the sump pressure curve and determining that the slope of the sump pressure curve falls below a threshold rate. Alternatively, controller 160 may also determine that the transition fill level has been reached by looking at a second derivative of a sump pressure curve. In this regard, controller 160 may identify a local maximum of the second derivative curve and this point may correspond to the time when the transition fill level has been reached. Other methods or algorithms for determining that the transition fill level has been reached are possible and within the scope of the present subject matter.

Although the examples above identify the transition fill level based on a when a slope of the pressure curve that falls below a predetermined threshold, it should be appreciated that according to alternative embodiments any other variation in the sump pressure curve may be used to identify a specific sump geometry or location and that variation may be used to identify a fill volume for determining the fill flow rate. For example, according to an alternative embodiment, the transition fill level may be defined at a region of decreased cross-sectional area (e.g., a necked or narrowed portion defined by cylindrical sidewalls 184) and the transition fill level may be identified by determining where the change of slope of the sump pressure curve increases, e.g., due to the sump geometry.

An exemplary sump pressure curve 300 is shown in FIG. 6. Notably, controller 160 may implement any suitable mathematical method for determining a slope of the sump pressure curve 300 (such as taking a derivative of the sump pressure curve 300). In this regard, referring for example to FIG. 6, the rate of change of the sump pressure or the sump pressure slope (e.g. as indicated by reference numeral 302) falls below a predetermined slope threshold at transition fill level 304. Thus, by continuously monitoring the slope of the sump pressure curve 300, and by knowing a slope threshold corresponding to the water level within sump 138 reaching transition fill level 190, controller 160 may accurately predict when transition fill level 190 has been reached. Notably, detection of this transition fill level 190 may be achieved using only a sump pressure sensor without other complex and costly sensors or detection systems.

Step 250 includes obtaining a transition fill volume of the water in the sump at the transition fill level and the transition fill time for the water to reach the transition fill level. In this regard, for example, the transition fill volume may be known or easily determined based on the sump geometry. In addition, the transition fill time may be the amount of time between when water supply valve 146 was opened (e.g., at step 220) and the time when the transition fill level is reached.

Step 260 includes determining a fill flow rate based on the transition volume, the start volume, and the transition fill time. For example, by knowing the start volume when water supply valve 146 is opened, the transition fill volume associated with the transition fill level, and the time required for to fill the difference in volume, a flow rate of water passing through water supply valve 146 may be calculated.

For example, according to an exemplary embodiment of the present subject matter, determining the fill flow rate may include using the following equation:

$$Q_{FILL} = \frac{(V_{TRANSITION} - V_{START})}{T_{TRANSITION}}$$

where: $Q_{FILL}$=the fill flow rate;
$V_{TRANSITION}$=the transition fill volume;
$V_{START}$=the start volume; and
$T_{TRANSITION}$=time required to reach the transition fill volume.

Notably, once the fill flow rate is determined, controller 160 may calculate the amount of time the water supply valve 146 must remain open to reach the target fill volume. In this regard, method 200 may further include, at step 270, determining a remaining fill time based on the target volume in the fill flow rate. For example, according to an exemplary embodiment, the remaining fill time may be determined using the following equation:

$$T_{FILL} = \frac{(V_{TARGET} - V_{TRANSITION})}{Q_{FILL}}$$

where: $T_{FILL}$=the time remaining to fill to the target volume;
$V_{TARGET}$=the target volume;
$V_{TRANSITION}$=the transition fill volume; and
$Q_{FILL}$=the fill flow rate.

After water is provided for the remaining fill time, the volume of water within sump 138 should be substantially equivalent to the target volume. Therefore, method 200 may further include closing the water supply valve to stop the flow of water into the sump and operating the circulation pump to circulate water to one or more spray arm assemblies within dishwasher appliance 100. Notably, controller 160 may be configured for performing method 200 during every fill cycle, such as during every wash or rinse cycle. According to alternative embodiments, controller 160 may perform method 200 periodically or intermittently in order to provide an estimate of the fill flow rate and improve the accuracy of the water fill cycles.

FIG. 5 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using dishwasher appliance 100 as an example, it should be appreciated that these methods may be applied to the operation of any suitable dishwasher, washing machine appliance, or other appliance where accurate water fill cycles are desirable.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance comprising:
a wash tub that defines a wash chamber;
a sump for collecting water, the sump defining a transition fill level, wherein the transition fill level corresponds to a location in the sump where a cross sectional area of the sump increases;
a water supply valve for selectively providing a flow of water into the sump;
a pressure sensor operably coupled to the sump; and
a controller communicatively coupled with the pressure sensor and the water supply valve, the controller being configured for:
obtaining a start volume;
opening the water supply valve to provide the flow of water into the sump;
monitoring a sump pressure using the pressure sensor;
determining, based on the sump pressure, that the water has reached the transition fill level;
obtaining a transition fill volume of the water in the sump at the transition fill level and a transition fill time for the water to reach the transition fill level;
determining a fill flow rate based on the transition fill volume, the start volume, and the transition fill time; and
determining a remaining fill time based on a target volume and the fill flow rate.

2. The dishwasher appliance of claim 1, wherein the start volume is substantially equal to zero.

3. The dishwasher appliance of claim 1, wherein the flow of water is provided into the sump at a substantially constant flow rate.

4. The dishwasher appliance of claim 1, wherein determining that the water has reached the transition fill level comprises:
determining that a rate of increase of the sump pressure falls below a predetermined threshold rate.

5. The dishwasher appliance of claim 1, wherein determining that the water has reached the transition fill level comprises:
obtaining a first pressure reading;
obtaining a second pressure reading a predetermined amount of time after the first pressure reading; and
determining that a difference between the first pressure reading and the second pressure reading falls below a predetermined pressure difference.

6. The dishwasher appliance of claim 1, wherein determining that the water has reached the transition fill level comprises:
obtaining a sump pressure curve of the sump pressure over time;
determining a slope of the sump pressure curve; and
determining that the slope of the sump pressure curve falls below a predetermined slope.

7. The dishwasher appliance of claim 1, wherein determining the fill flow rate comprises using the following equation:

$$Q_{FILL} = \frac{(V_{TRANSITION} - V_{START})}{T_{TRANSITION}}$$

where: $Q_{FILL}$=the fill flow rate;
$V_{TRANSITION}$=the transition fill volume;
$V_{START}$=the start volume; and
$T_{TRANSITION}$=time required to reach the transition fill volume.

8. The dishwasher appliance of claim 1, wherein determining a remaining fill time comprises using the following equation:

$$T_{FILL} = \frac{(V_{TARGET} - V_{TRANSITION})}{Q_{FILL}}$$

where: $T_{FILL}$=the time remaining to fill to the target volume;
$V_{TARGET}$=the target volume;
$V_{TRANSITION}$=the transition fill volume; and
$Q_{FILL}$=the fill flow rate.

9. The dishwasher appliance of claim 1, further comprising a circulation pump in fluid communication with the sump for circulating the water to one or more spray arm assemblies, wherein the controller is further configured for:
closing the water supply valve to stop the flow of water into the sump after determining that the target volume has been reached; and
operating the circulation pump to circulate water to the one or more spray arm assemblies.

10. The dishwasher appliance of claim 1, wherein the transition fill level corresponds to a height of a shoulder of the sump.

11. The dishwasher appliance of claim 1, wherein the controller is configured for determining the remaining fill time before operating a circulation pump during every wash cycle or rinse cycle.

* * * * *